United States Patent [19]

Tang

[11] 4,395,852

[45] Aug. 2, 1983

[54] GUTTER GUARD

[75] Inventor: Darl L. Tang, Elmhurst, Ill.

[73] Assignee: Robert G. Carter, Elmhurst, Ill. ; a part interest

[21] Appl. No.: 253,776

[22] Filed: Apr. 13, 1981

[51] Int. Cl.[3] ..... E04D 13/06

[52] U.S. Cl. ..... 52/12

[58] Field of Search ..... 52/11–13

[56] References Cited

U.S. PATENT DOCUMENTS

| | | | |
|---|---|---|---|
| 2,175,138 | 10/1939 | Westlake | 52/12 |
| 2,271,081 | 1/1942 | Layton | 52/12 |
| 2,583,422 | 1/1952 | Haddon | 52/12 X |
| 3,053,393 | 9/1962 | McLean | 52/12 X |
| 4,254,595 | 3/1981 | Crosslen | 52/11 |
| 4,286,418 | 9/1981 | Snyder | 52/11 |

FOREIGN PATENT DOCUMENTS

| | | | |
|---|---|---|---|
| 45489 | 2/1982 | European Pat. Off. | 52/11 |

*Primary Examiner*—J. Karl Bell

*Attorney, Agent, or Firm*—Kinzer, Plyer, Dorn & McEachran

[57] ABSTRACT

A guard for an open top gutter mounted on the eaves of a building of the type having a roof covering with a peripheral edge of the roof covering adjacent to the gutter arranged so it can be lifted slightly to receive a portion of the gutter guard. The gutter guard includes an elongated generally rectangular sheet of thin, flexible, resilient plastic material having a width about twice the width of the open top of the gutter. The plastic sheet is divided longitudinally into imperforate and perforate portions, each portion adapted to be alternately positioned under the peripheral edge of the roof covering with the other portion positioned over the gutter. The outer longitudinal edges of the sheet are formed with narrow bendable flaps, defined by fold lines, and the imperforate and perforate portions of the sheet are separated by another fold line. A clip fits over the top rim of the gutter and receives the edge of the guard and its flap to hold the guard in position on the gutter.

6 Claims, 5 Drawing Figures

Fig. 1.
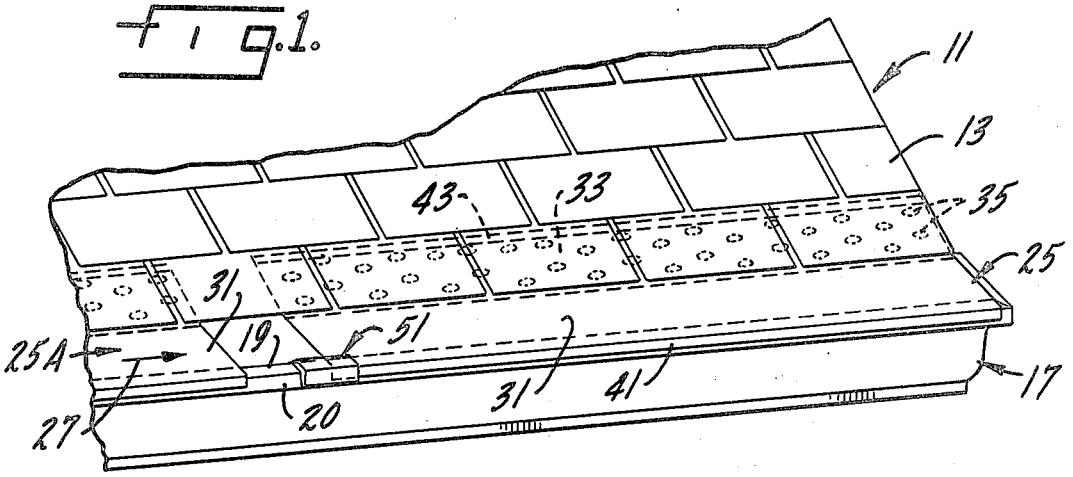
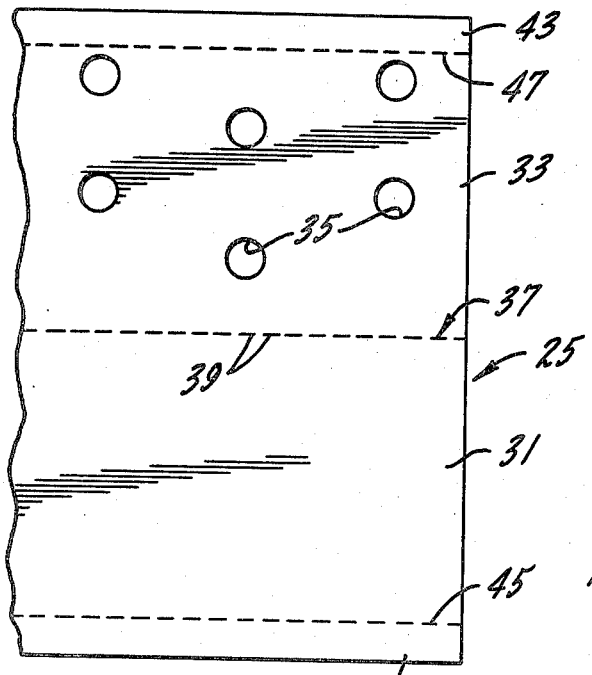
Fig. 2.
Fig. 3.
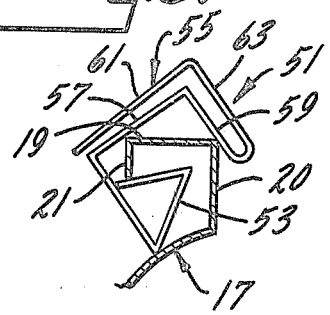
Fig. 4.
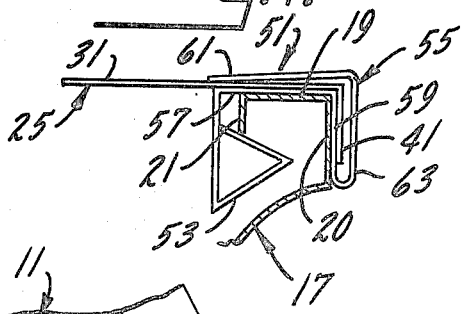
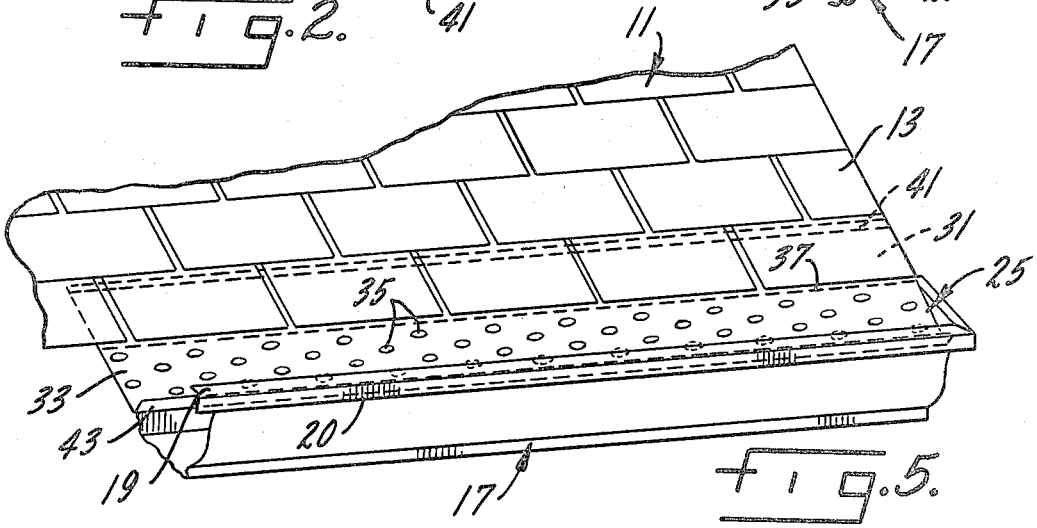
Fig. 5.

GUTTER GUARD

BACKGROUND OF THE INVENTION

Gutters have been conventionally installed on buildings having pitched roofs, especially residential type buildings, to prevent precipitation which flows off the roof from damaging the walls and foundation of the building and landscaped areas around the building. However, gutters present problems during the autumn and winter, especially in areas with deciduous trees and colder areas having considerable snowfall. In the autumn, leaves and twigs from deciduous trees fall onto the roofs of buildings and are carried into the gutters, where they block the gutters and downspouts. In cold climates where there is substantial snow followed by changing temperatures, snow accumulates on a roof, melts and refreezes. This causes a buildup of what is commonly called an ice dam in the gutter. The ice extends from the gutter over the roof which is usually covered with shingles. Heat escaping from inside the building melts the underside of the ice and water is forced under the shingles and into the building, where it can do considerable damage to the interior of the building, particularly the ceilings and walls.

Numerous attempts have been made over the years to solve these problems. One series of attempts has involved the installation of perforated or solid coverings for the gutters to prevent the accumulation of snow, leaves and debris in the gutters. When solid covers have been used, a space has been left between the cover and the gutter to permit water from the roof to flow into the gutter. The space must be sufficiently small to block the accumulation of ice, snow, leaves and debris. The use of perforated or solid coverings have been shown in the following U.S. patents:

| Name | U.S. Pat. No. |
|---|---|
| J. L. Schaffert | 274,393 |
| J. Phelps | 406,233 |
| J. M. Van Horn | 546,042 |
| G. Cassen | 836,012 |
| J. O'Dowd | 846,238 |
| L. E. Sullivan et al | 2,209,741 |
| P. N. Layton | 2,271,081 |
| A. P. Couture | 2,805,632 |
| L. A. McLean | 3,053,393 |
| D. A. South | 3,550,381 |
| R. Zukauskas | 3,950,951 |

Still other attempts to solve these problems are shown in such U.S. patents as Noce U.S. Pat. No. 1,141,204, in which a gutter is swingably mounted on a building and has a counterbalance which normally holds it in the water receiving position. This gutter can be dumped to remove ice and snow which accumulates in it. Another attempt is shown in Teutsch U.S. Pat. No. 2,851,969 in which an imperforate cover is pivotably mounted over a gutter. The cover automatically tilts to an open position, allowing water to flow into the gutter, when a receptacle fills with water. For one reason or another, none of these various attempts to solve the problems of the accumulation of leaves, debris, ice and snow in the gutters has been entirely successful.

SUMMARY OF THIS INVENTION

It is an object of the invention, therefore, to provide a gutter guard which protects a gutter against the accumulation of leaves and debris during the late summer and autumn and also protects the gutter against the accumulation of snow and ice during the winter.

Another object of this invention is a gutter guard that is light in weight and easy to install in and remove from a gutter, but nevertheless is strong and relatively inexpensive.

Another object of this invention is a gutter guard which functions alternately as a screen and a cover and may easily be reversed to perform either function.

Another object of this invention is a gutter guard which is firmly held to the gutter by an easily installable clip.

Another object of this invention is a gutter guard which excludes leaves and debris from trees but can handle heavy rains.

Accordingly, the invention relates to a guard for an open top gutter mounted on the eaves of a building of the type having a roof covering with a peripheral edge of the roof covering adjacent to the gutter that can be lifted slightly to receive the guard. The gutter guard includes an elongated generally rectangular sheet of relatively thin, flexible, resilient plastic having a length at least several times greater than its width. The width of the plastic sheet is of the order of twice the width of the open top of the gutter. The plastic sheet is divided longitudinally into an imperforate portion and a multiperforate portion by a fold line. Each of the imperforate and perforate portions of the sheet are adapted to be positioned under the peripheral edge of the roof covering with the other portion positioned over the open top of the gutter. The outer longitudinal edges of the imperforate and perforate portions of the sheet are preferably formed with narrow bendable flaps defined by fold lines. The flaps may be bent at right angles to the sheet so a flap can extend downwardly over the gutter rim when its contiguous portion is covering the open top of the gutter. A clip is provided to fit over the gutter rim and receive the downwardly extending flap to hold the guard in position on the gutter.

BRIEF DESCRIPTION OF THE DRAWINGS

FIG. 1 is a partial perspective view of the roof of a building having a gutter guard installed in a gutter and another guard being installed, with the guards shown in their winter orientation;

FIG. 2 is a plan view of a portion of the gutter guard of this invention;

FIG. 3 is a partial enlarged cross sectional side view showing a clip being installed on the rim of a gutter;

FIG. 4 is a partial cross sectional view showing a gutter guard held by a clip locked into position on the rim of a gutter; and FIG. 5 is a partial perspective view of the roof of a building showing a gutter guard installed in a gutter in its autumn orientation.

DETAILED DESCRIPTION OF THE PREFERRED EMBODIMENT

FIG. 1 of the drawings shows a portion of a roof 11 of a building. The roof is sloped, as is conventional, and is covered with overlapping shingles 13. A gutter 17, conventionally of metal, either galvanized steel or aluminum, is attached to the eave at the lower edge of the roof. The gutter, as shown in detail in FIGS. 3 and 4, has a flat top rim 19 formed at the top of an outside wall 20. The top rim terminates inwardly with a downwardly extending lip 21. A guard 25 is installed covering a portion of the open top of the gutter 17 in FIG. 1 and a second guard 25A is being slid in position as indicated by the arrow 27.

A portion of a typical gutter guard 25 of my invention is shown in detail in FIG. 2 of the drawings. The guard 25 is made from an elongated, generally rectangular sheet of a thin, flexible, resilient plastic material such as natural linear U.V.I. polyethylene, although it should be understood and appreciated that other types of plastic material may be used. The length of the guard may be varied depending on the availability of stock sheets of material and also taking into consideration the ease of handling of an elongated sheet of the material. The sheet 25 is divided longitudinally, by a score line 37, into an imperforate portion 31 and a perforated portion 33 having multiple spaced apertures 35. The score line 37 is preferably formed of aligned notches or indentations 39 which do not extend entirely through the plastic sheet material. Longitudinally extending flaps 41 and 43 are formed, respectively, on the outer edges of the imperforate and perforate portions 31 and 33 of the sheet 25. The flaps 41 and 43 are separated from their respective sections by score lines 45 and 47, respectively, formed in the same manner as the score line 37. The score lines permit the imperforate and perforated portions to be bent obliquely relative to each other and permit the flaps to be bent relative to their respective portions on the installation site without the need for special tools. The width of the gutter guard 25 between the flaps 41 and 43 should be about twice the width of the open top of the gutter 17.

Guard retaining clips 51 are shown in detail in FIGS. 3 and 4 of the drawings. The clips are preferably formed of a white rigid polyvinylchloride in an irregular cross sectional shape. The preferred length of a clip is approximately one and one-half inches although this dimension may be varied considerably. The clip 51 is formed having a gutter rim engaging portion 53 of triangular cross section and an integral guard receiving portion 55 in the form of an L-shaped pocket. The inner walls 57 and 59 of the L-shaped pocket rest on the gutter top rim 19 and side wall 20, respectively, as shown in FIG. 4. The outer walls 61 and 63 of the clip cooperate with the inner walls thereof to form the guard receiving portion 55.

The winter installation of the guard 25 is shown in FIG. 1 of the drawings. One guard sheet 25 is shown positioned on the gutter 17 with its perforated portion 33 and flap 43 located under the shingles 13. The imperforate portion 31 extends over the open top of the gutter 17 and its flap 41 fits over and against the outer side wall 20 of the gutter. The flap 41 is bent downwardly at right angles relative to its imperforate portion 31 and both extend into the guard receiving pocket 55 of a clip 51 mounted over the top rim 19 of the gutter as shown in detail in FIG. 4 of the drawings. A similar guard 25A is shown in the process of installation on the gutter 17, with its perforated portion 33 already inserted under the shingles 13. It can then be slid in the direction of the arrow 27 until its imperforate portion 31 and flap 41 are seated in the pocket 55 of the clip 51. Additional clips 51 and guards 25 are installed until the gutter is completely enclosed.

The summer and autumn orientation of the guard 25 is shown in FIG. 5 of the drawings. During this period of the year, the imperforate portion 31 of the guard 25 and its flap 41 are inserted under the shingles 13. The perforated portion 33 of the guard extends across the open top of the gutter. The flap 43 is bent upwardly at right angles relative to the perforated portion 33 and it extends beneath the top rim 19 of the gutter between the side wall 20 and downwardly turned lip 21 thereof. It is not necessary to use a clip for the summer installation since heavy weights of snow and ice will not be resting on the gutter guard. Further, the perforate portion 33 and its flap 43 are located under the rim 19 of the gutter so that heavy rains can bend the perforated portion 33 of the gutter guard downwardly, permitting a greater quantity of water to flow into the gutter than could flow through the circular passages 35.

In areas where heavy rainfall is experienced during the summer and minimal pods, leaves and debris fall from trees, the gutter guard can be removed during spring and summer weather. Easy removal and installation of the gutter guard is facilitated by its light weight and ease of assembly and disassembly.

The overall width of the gutter guard, exclusive of the flaps, need not be precisely matched to twice the width of the gutter. If the guard is a little wider than twice the gutter width, it can still be fitted onto the gutter with only minimal upward bending of the outer edge of the roof covering. If the guard is slightly narrower, a slightly smaller portion is inserted under the roof covering, which is no handicap as long as, in the winter orientation, no appreciable number of the apertures 35 are exposed.

I claim:

1. A guard for an open top gutter mounted on the eaves of a building of the type having a roof covering with a peripheral edge of the roof covering adjacent to the gutter that can be lifted slightly to receive the guard, the guard including:

an elongated generally rectangular sheet of thin flexible resilient plastic material having a length at least several times greater than its width, with the width of the sheet being on the order of twice the width of the open top of the gutter, the plastic sheet being divided longitudinally into an imperforate portion and a perforate portion, each portion of the plastic sheet having a width approximately equal to the width of the open top of the gutter, the imperforate and perforate portions of the sheet being alternately slidable under the peripheral edge of the roof covering with the other portion of the sheet positioned over the open top of the gutter.

2. The guard of claim 1 in which the imperforate and perforate portions of the sheet are separated by a fold line formed in the sheet.

3. The gutter guard of claim 1 in which the outer longitudinal edges of the imperforate and perforate portions of the sheet are formed with narrow bendable flaps.

4. The guard of claim 3 in which the longitudinal extending flaps are separated from the imperforate and perforated portions of the sheet by fold lines formed in the sheet.

5. The guard of claim 4 in which the gutter is equipped with an inwardly directed generally horizontal top rim and the longitudinal flap on the imperforate portion is bent at right angles to its portion and extends downwardly over the top rim of the gutter when the imperforate portion is covering the open top of the gutter, and a clip is provided which fits over the top rim of the gutter and receives the imperforate portion and its downwardly extending tab to hold the guard in position on the gutter.

6. The gutter guard of claim 2 in which the outer longitudinal edges of the imperforate and perforate portions of the sheet are formed with narrow bendable flaps.

* * * * *